US008091168B2

(12) United States Patent
Holm et al.

(10) Patent No.: US 8,091,168 B2
(45) Date of Patent: Jan. 10, 2012

(54) HANDHELD VACUUM CLEANER

(75) Inventors: Henrik Holm, Lidingö (SE); Roger Karlsson, Stockholm (SE); Oskar Fjellman, Stockholm (SE)

(73) Assignee: AB Electrolux, Stockholm (SE)

( * ) Notice: Subject to any disclaimer, the term of this patent is extended or adjusted under 35 U.S.C. 154(b) by 309 days.

(21) Appl. No.: 12/442,854

(22) PCT Filed: Sep. 21, 2007

(86) PCT No.: PCT/SE2007/000826
§ 371 (c)(1), (2), (4) Date: Mar. 25, 2009

(87) PCT Pub. No.: WO2008/039127
PCT Pub. Date: Apr. 3, 2008

(65) Prior Publication Data

US 2010/0088841 A1 Apr. 15, 2010

(30) Foreign Application Priority Data

Sep. 25, 2006 (SE) ..... 0601990

(51) Int. Cl.
*A47L 5/24* (2006.01)

(52) U.S. Cl. ..... 15/3; 15/344; 15/328; 15/329; 15/347; 15/352

(58) Field of Classification Search ..... 15/3, 328, 15/329, 344, 347, 350, 352
See application file for complete search history.

(56) References Cited

U.S. PATENT DOCUMENTS

| | | | | |
|---|---|---|---|---|
| 3,513,500 | A * | 5/1970 | Hori | 15/344 |
| 6,839,934 | B2 * | 1/2005 | Houghton et al. | 15/329 |
| 2006/0090290 | A1 * | 5/2006 | Lau | 15/344 |

* cited by examiner

*Primary Examiner* — Robert Scruggs
(74) *Attorney, Agent, or Firm* — Hunton & Williams LLP

(57) ABSTRACT

A handheld vacuum cleaner housing with a frame element forming at least a portion of a handle and extending in a main handle direction. A through hole passes through and is encircled by the frame element, and is configured to receive one or more fingers of an operator. A top casing element is connected to the frame element and covers at least some of a top side of the frame element. A bottom casing element is connected to the frame element and covers at least some of the bottom side of the frame element. The frame element, top casing element and bottom casing element are arranged to form at least part of a vacuum source housing for accommodating at least a part of a vacuum source. A vacuum cleaner having a similar housing, as well as a detachable second housing having a debris compartment and nozzle, is also provided.

16 Claims, 2 Drawing Sheets

HANDHELD VACUUM CLEANER

TECHNICAL FIELD OF THE INVENTION

The present invention relates to a handheld vacuum cleaner comprising a handle part, which handle part is provided with a through hole for receiving one or several fingers of an operator.

BACKGROUND ART

While a full sized upright or canister vacuum cleaners normally are used to do the bulk of the cleaning in the home, there are often needs that can be fulfilled by a lightweight, handheld vacuum cleaner. These vacuum cleaners are available in many different embodiments. A common feature is that they are compact and lightweight such that they can be easily carried around for quick and easy cleaning of, for example, unexpected small spills, upholstered furniture or drapes. They are also advantageous in narrow or limited spaces such as closet floors or stair steps.

In order to facilitate carrying, a hand held vacuum cleaner is usually provided with a handle. One kind of known handle is a through hole extending from one side to another at a rear end of the vacuum cleaner housing. An operator can insert his fingers in the hole and grip around an upper portion of the housing for carrying the vacuum cleaner and moving the vacuum cleaner over a surface to be cleaned.

Furthermore, the housing of a handheld vacuum cleaner is normally spilt in two halves along a vertical center plane, such as in for example the handheld vacuum cleaner described in U.S. Pat. No. 4,924,548, which is incorporated herein by reference.

Although handhelds vacuum cleaners are relatively lightweight, the weight of the vacuum unit, including a motor and a fan, is still not negligible. Since the handle, for convenience of operation, normally is placed at a rear end of the vacuum cleaner, the weight of the vacuum unit is offset from the handle. Thus, a problem with handheld vacuum cleaners is that the handle is exposed to high stress when the vacuum cleaner is carried and especially, when the direction of movement is swiftly changed, which is common in vacuum cleaning. This may cause the housing to become unstable and fractures may even appear at the handle.

It is an object of the present invention to address one or more of the above-mentioned problems, which may be accomplished by various embodiments of the invention.

SUMMARY OF THE INVENTION

In one aspect, there is provided a housing for a handheld vacuum cleaner. The housing includes a frame element, a through hole, a top casing element, and a bottom casing element. The frame element forms at least a portion of a handle and extends in a main handle direction. The through hole passes through and is encircled by the frame element, extends sideways and substantially perpendicular to the main handle direction, and is configured to receive one or more fingers of an operator. The top casing element is connected to the frame element and covers at least a portion of a top side of the frame element. The bottom casing element is connected to the frame element and covers at least a portion of the bottom side of the frame element. The frame element, top casing element and bottom casing element are arranged to form at least part of a vacuum source housing for accommodating at least a part of a vacuum source.

In another aspect, there is provided a vacuum cleaner. The vacuum cleaner has a first housing and a second housing. The first housing includes a frame element, a through hole, a top casing element, and a bottom casing element. The frame element forms at least a portion of a handle and extends in a main handle direction. The through hole passes through and is encircled by the frame element, extends sideways and substantially perpendicular to the main handle direction, and is configured to receive one or more fingers of an operator. The top casing element is connected to the frame element and covers at least a portion of a top side of the frame element. The bottom casing element is connected to the frame element and covers at least a portion of the bottom side of the frame element. The frame element, top casing element and bottom casing element are arranged to form at least part of a vacuum source housing for accommodating at least a part of a vacuum source. The second housing includes a debris collecting compartment and a nozzle, and is detachably connected to the first housing adjacent the vacuum source housing.

Other aspects of the invention will be apparent from the disclosure and claims, and the recitation of this summary of the invention is not intended to limit the claimed invention in any way.

BRIEF DESCRIPTION OF THE DRAWINGS

The invention may be performed in many various ways, and by way of example only, an embodiment thereof will now be described in detail with reference being made to the accompanying drawings, in which.

DETAILED DESCRIPTION OF EXEMPLARY EMBODIMENTS OF THE INVENTION

Figure 1:
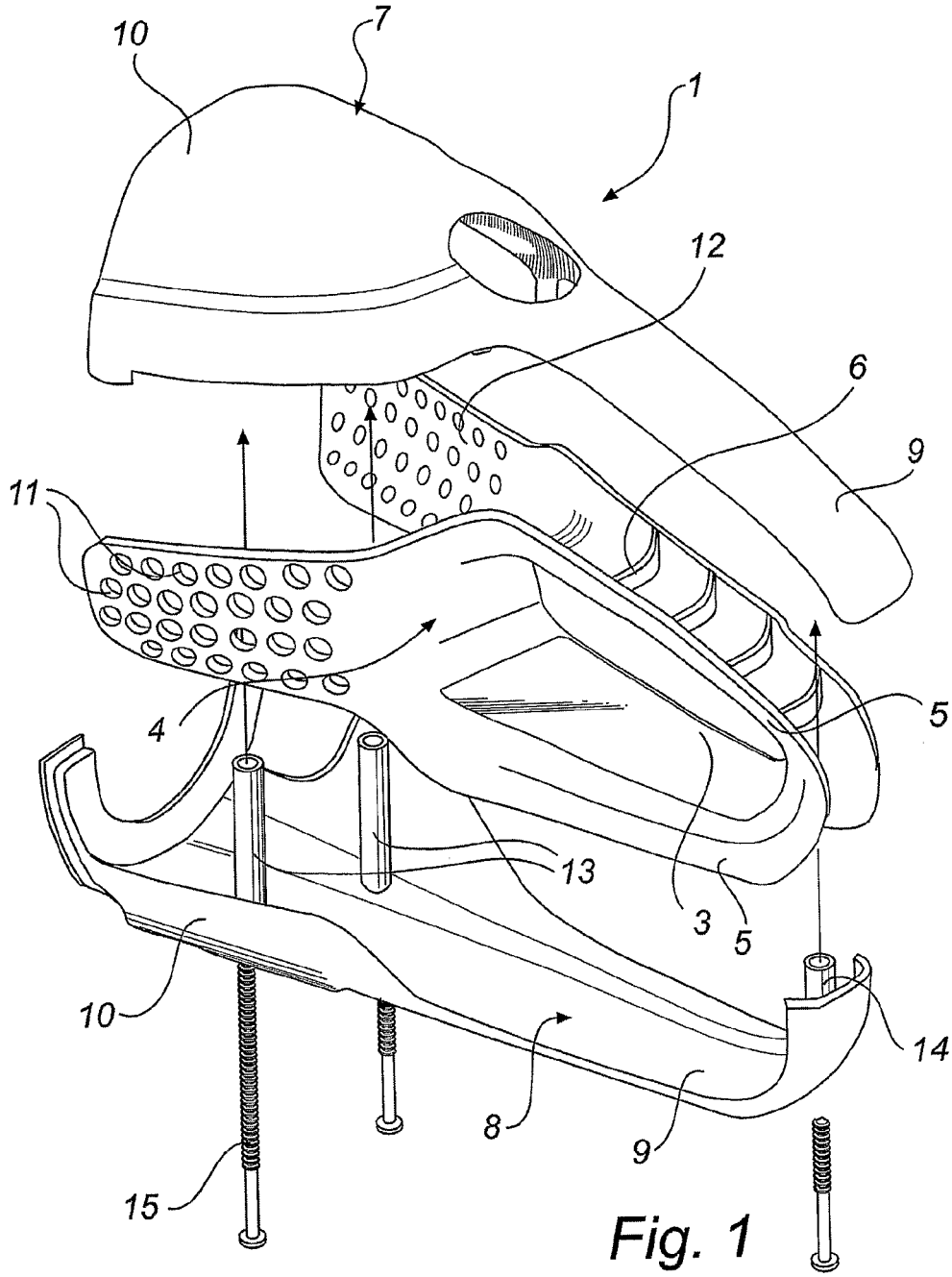
FIG. 1 is an exploded view of a first housing of a handheld vacuum cleaner according to one embodiment of the invention.

Generally speaking, a handheld vacuum cleaner according to the invention may include a handle part, which handle part extends in a main handle direction; is provided with a through hole for receiving one or several fingers of an operator, which through hole extends sideways and substantially perpendicular to the main handle direction; and which handle part comprises a frame element, which frame element extends in the main handle direction and encircles the through hole. The handheld vacuum cleaner may further comprise a top casing element and a bottom casing element, wherein the frame element, the top casing element and the bottom casing element are arranged to form a housing for accommodating at least a part of a vacuum source. The top casing element may be connected to the frame element and cover at least a portion of the top side of the frame element, and the bottom casing element may be connected to the frame element and cover at least a portion of the bottom side of the frame element.

In one embodiment, the shape of the frame element as a complete, closed loop around the through hole, provides a firm base for the handle portion and very good resistance to bending forces. In addition, the top casing element and the bottom casing element may extend at least a portion over and under the frame element respectively, and be connected to the frame element at a top side and a bottom side thereof respectively. Together with the shape of the frame element, this provides for a very robust mounting of the handle and excellent resistance to shearing and bending forces.

In contrast, the housing of a handheld vacuum cleaner of the prior art is normally split in two halves along a vertical center plane. When the vacuum cleaner is carried and used and the handle is subjected to gravity and momentum forces, the halves may be forced to displace and the vacuum cleaner housing may become instable and possibly break. The closed construction of the frame element of the vacuum cleaner according to the invention, and the mounting of the frame element between portions of the top casing element and the bottom casing element, may contribute to a vacuum cleaner housing having increased stability and stress durability at least at the handle part.

The discussed embodiments of the present invention relate to handheld vacuum cleaners, i.e. vacuum cleaners that are small in size and lightweight as compared to a full sized upright or canister vacuum cleaner, and which can easily be carried around for cleaning of smaller or hard. to reach surfaces, for example for cleaning of small spills, upholstered furniture, drapes, closet floors or stair steps. But other applications will be apparent to persons of ordinary skill in the art in view of this disclosure.

Vacuum cleaners according to various embodiments of the invention can have any suitable vacuum source. The components of a vacuum source normally include an electric motor and a fan. A debris collecting compartment and various filters may be used with the vacuum source to collect and retain dirt, as known in the art. The vacuum source can be powered in any suitable way. The vacuum cleaner can, for example, be a battery operated cleaner or a corded cleaner.

According to exemplary embodiments of the invention, at least a part of the vacuum source may be accommodated in a housing formed of the top casing element, the bottom casing element and the frame element. Further, at least a part of the housing of the vacuum cleaner may be comprised of casing elements assembled over mainly horizontal planes. Thus, the housing pieces can be assembled in a vertical direction and interlocked by screws inserted from the bottom of the housing. Consequently, the screws are not visible during normal use of the vacuum cleaner, as is the case with many prior art handheld vacuum cleaners. Other suitable ways of fastening the housing elements together are also possible, for example by gluing or by an interlocking form of the elements.

Embodiments of the invention may comprise handheld vacuum cleaners of the type having a handle part that is provided with a through hole. In such embodiments, the handle part may extend from the part of the housing accommodating the vacuum source in a main handle direction. Normally the handle is located at a rear end of the vacuum cleaner and extends in the longitudinal direction of the vacuum cleaner, but other locations and directions are also possible. The through hole of the handle part may extend sideways, i.e. from a left side to a right side of the vacuum cleaner, wherein "left" and "right" relates to the vacuum cleaner when oriented for normal operation. The through hole may be lined with a frame element, which completely surrounds the hole when viewed in the sideway direction along the extension of the hole. The hole is dimensioned such that it can receive at least one finger of an operator. Thus, an operator can insert at least one finger into the hole and grip around an upper portion of the handle including the upper portion of the frame element.

The through hole, as seen from the left or right side of the vacuum cleaner, can have any suitable shape, for example substantially oval, circular, rectangular or quadratic. The frame element will have a corresponding shape as seen from the left or right side. Furthermore, the frame element can have any suitable cross section along a the hole encircling body thereof, for example a solid circular or rectangular cross section, or a U-shaped cross section. The cross section need not be constant.

According to one embodiment of the present invention, the frame element has a U-shaped cross section, wherein the legs of the U extend radially outwards from the center of the through hole. Thereby the strength of the frame element is even further increased. Another advantage is that there will be no joints between the frame element and any housing parts at the part of the handle where the weight of the vacuum cleaner is transmitted to the hand of the operator.

According to one embodiment of the present invention, the frame element is a continuous, one-piece element that encircles the through hole. Thereby an especially strong construction of the frame element is achieved. The frame element can for example be a molded plastic component. However, it could be possible to obtain similar strength also with a frame element comprised of several frame element pieces if these are rigidly interconnected, for example by overlapping portions. Another advantage of a continuous, one-piece frame element is that there are no joints of different housing parts inside the hole of the handle. Thus, the vacuum cleaner according to this embodiment of invention is more comfortable to carry than prior art vacuum cleaner comprised of two vertical housing halves.

According to one embodiment of the invention, the top casing element and the bottom casing element may be fixed to and cover a major portion of the top side and the bottom side of the frame element, respectively. It is also possible that the top casing element and the bottom casing element, from the top side and the bottom side respectively, completely embrace the frame element. Due to the weight of the vacuum cleaner thereby being distributed to a larger portion of the frame element, the strength of the handle part is even further improved in these embodiments. Furthermore, in these embodiments the resistance of the handle part against shearing forces is further increased. In other words, any forces acting to deform for example a rectangular frame element into a parallelogram, are absorbed by the top casing element and the bottom casing element. Of course, the top casing element and the bottom casing element also contribute to the absorption of bending and other forces.

The top casing element and the bottom casing element can have a spoon-like shapes, each including an elongated handle attachment part and a bowl-like housing forming part. The handle attachment parts are attached to the frame element and cover at least a portion thereof and the housing forming parts form the housing together with a portion of the frame element.

According to one embodiment, the housing may include a portion for accommodating at least a part of the vacuum source, which portion further includes a first and a second side casing part. These side casing parts make up a respective portion between the top casing element and the bottom casing element at the left and right side of the housing, respectively. The first and a second side casing parts are connected to or in one piece with the frame element. Thus, the frame element extends into the housing for accommodating the vacuum source, and the top and bottom casing elements extend over the frame element. Consequently, the frame element and the top and bottom casing parts interact at both the handle part and the housing part of the vacuum cleaner, which further contributes to the stability and strength of the construction.

According to one embodiment, the top casing element and the bottom casing element each are an integral, one-piece element, such as molded plastic components.

According to another exemplary embodiment, the frame element, the top casing element and the bottom casing element are arranged to form a first housing for accommodating a motor and a fan of the vacuum source. The handheld vacuum cleaner further comprises a second housing for accommodating a debris collecting compartment of the vacuum source and a nozzle. Thus, the components of the vacuum source that together contribute a major portion of the weight of the vacuum cleaner are housed in the first housing, which is constructed with a stable handle construction and mounting. The second housing is detachably connected to the first housing in the main handle direction, to, for example, enable emptying of the debris collecting compartment.

Having described various features of exemplary embodiments above, specific examples of embodiments are described below with reference to the attached Figures.

In FIG. 1, a first housing 1 of a handheld vacuum cleaner according to one embodiment of the invention is shown. The first housing 1 includes a handle part 2 located at a rear end of the vacuum cleaner and extending in a main handle direction being the longitudinal direction of the handheld vacuum cleaner.

The handle part 2 is provided with a through hole 3, which extends substantially perpendicular to main handle direction sideways between the left side and the right side of the vacuum cleaner. The through hole 3 is of oval shape and big enough to receive the fingers and a hand of an operator.

The through hole 3 is lined with a frame element 4, which completely encircles the through hole 3. The left and the right sides, in relation to the vacuum cleaner, of the frame element 4 are provided with respective radially outward extending flanges 5. Thus, the frame element 4 has a substantially U-shaped cross section along a top side, a rear side and a bottom side thereof. In addition, the frame element may be provided with enforcement ribs 6, such as the shown ribs that join the opposed flanges 5.

The first housing 1 further includes a top casing element 7 and a bottom casing element 8 of spoon-like shape. The top casing element 7 and the bottom casing element 8 each include a narrow handle attachment part 9 and a bowl-like housing part 10. The top casing element 7 and the bottom casing element 8, each are separate, integrated, one-piece plastic molded elements.

The bottom casing element is provided with two front end guiding tubes 13 and one rear end guiding tube 14.

The first housing 1 includes a left casing part 11 and a right casing part 12. On the left side, the left casing part 11 is located between the housing parts 10 of the top and bottom casing element 7, 8. On the right side, the right casing part 12 is located between the housing parts 10 of the top and bottom casing element 7, 8. The right and left casing parts 11, 12 are connected to the frame element 4 at the front end thereof, which faces the vacuum source. The left casing part 11 and the right casing part 12 may be provided with through air holes for letting out exhaust air from the vacuum source.

In the described embodiment, the frame element 4, including the hole encircling body, the flanges 5, the left casing part 11 and the right casing part 12, is an integrated, one-piece plastic molded element.

When the first housing 1 of the vacuum cleaner is assembled, the frame element 4 is placed on the bottom casing element 8, and the top casing element 7 is placed on the frame element 4. The handle attachment part 9 of the top casing element 7 covers the top side and a top portion of the rear side of the hole encircling part of the frame element 4. The handle attachment part 9 of the bottom casing element 8 covers the bottom side and a bottom portion of the rear side of the hole encircling part of the frame element 4. At the rear side of the frame element 4, the handle attachment parts 9 of the top and bottom casing element 7, 8 meet, such that the frame element 4 is embraced by the handle attachment parts 9.

For tightly locking together the elements 4, 7 and 8, screws 15 are inserted from below in the guiding tubes 13 and 14. The screws pass the frame element 4 in the guiding tubes and are screwed directly into the top casing element 8. Thus, the frame element 4 is firmly clamped between the top and the bottom casing elements 7, 8, while at the same time screws are only visible from below. Furthermore, the interaction of on the one hand, the closed hole encircling body of the frame element 4 with the handle attachment parts 9 of the top and bottom casing elements 7, 8, and on the other hand, the side casing parts 11, 12 of the frame element 4 with the housing parts 10 of the top and bottom casing elements 7, 8, ensures a strong stable construction of handle part and vacuum source accommodating housing part.

Figure 2:
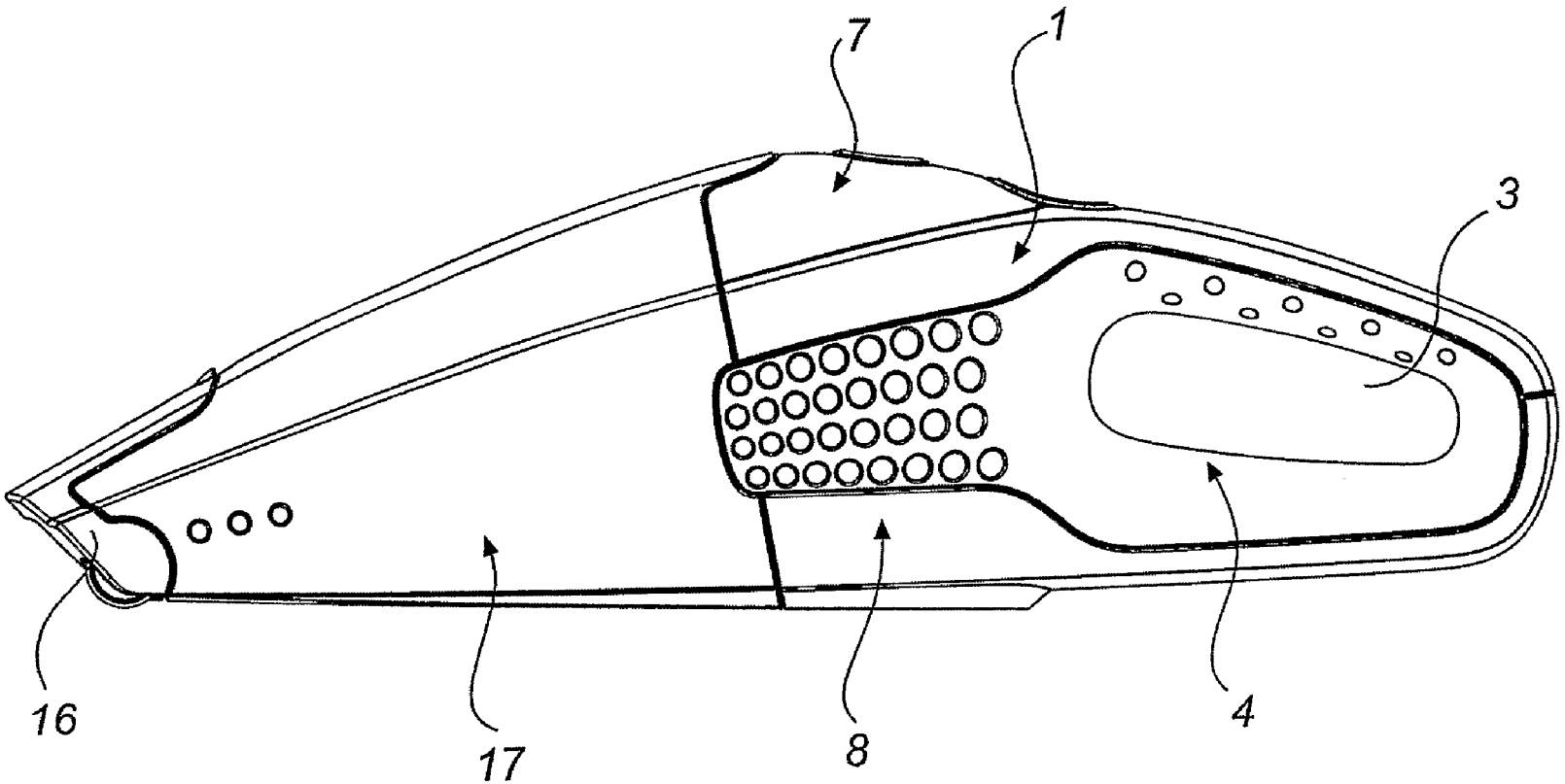
FIG. 2 is a side view of a handheld vacuum cleaner according to one embodiment of the invention.

In FIG. 2, a complete handheld vacuum cleaner according to this embodiment of the invention is shown. In addition to the first housing 1 described above, the vacuum cleaner comprises a second housing 17 accommodating a nozzle 16 and a debris collecting compartment. The second housing 17 is detachably connected to the first housing 1 for-enabling emptying of the debris collecting compartment. A vacuum source 18, including a fan 19 and motor 20 is shown mounted in the first housing 1, as described above.

The present disclosure describes a number of new, useful and nonobvious features and/or combinations of features that may be used alone or together. The embodiments described herein are all exemplary, and are not intended to limit the scope of the inventions in any way. It will be appreciated that the inventions described herein can be modified and adapted in various ways and for different uses, and all such modifications and adaptations are included in the scope of this disclosure and the appended claims.

We claim:

1. A housing for a handheld vacuum cleaner, the housing comprising:

a frame element forming at least a portion of a handle and extending in a main handle direction;

a through hole passing through and encircled by the frame element, the through hole extending sideways and substantially perpendicular to the main handle direction, and being configured to receive one or more fingers of an operator;

a top casing element connected to the frame element and covering at least a portion of a top side of the frame element; and a bottom casing element connected to the frame element and covering at least a portion of the bottom side of the frame element;

a first side casing part disposed on one side of the housing; and a second side casing part disposed on opposite side of the housing;

wherein the first side casing part and second side casing part extend between the top casing element and the bottom casing element, and are formed as a single, one-piece element with the frame element; and wherein the frame element, the top casing element, the bottom casing element, the first side casing part and the second side casing part are arranged to form at least part of a vacuum source housing for accommodating at least a part of a vacuum source.

2. The housing according to claim 1, wherein the frame element comprises a single continuous piece that encircles the through hole.

3. The housing according to claim 1, wherein the frame element comprises flanges extending on both sides of the frame element around at least a portion of the through hole to thereby provide the frame element with a generally U-shaped cross section along the portion.

4. The housing according to claim 3, wherein the portion comprises a majority of the through hole.

5. The housing according to claim 1, wherein the through hole is substantially oval.

6. The housing according to claim 1, wherein at least one of the first side casing part and the second side casing part comprises one or more air openings adapted to pass exhaust air from the vacuum source.

7. The housing according to claim 1, wherein the top casing element covers at least a major portion of the top side of the frame element, and wherein the bottom casing element covers at least a major portion of the bottom side of the frame element.

8. The housing according to claim 7, wherein the top casing element and the bottom casing element contact each other at least one point.

9. The housing according to claim 8, wherein the top casing element and the bottom casing element contact each other at an end of the housing distal from the vacuum source housing.

10. The housing according to claim 1, wherein at least one of the top casing element and the bottom casing element comprises an integral, one-piece element.

11. The housing according to claim 1, wherein the frame element is clamped between the top casing element and the bottom casing element by screws inserted in the bottom casing element and screwed into corresponding threads in the top casing element to thereby form the handle.

12. A vacuum cleaner comprising:

a first housing comprising:

a frame element forming at least a portion of a handle and extending in a main handle direction, a through hole passing through and encircled by the frame element, the through hole extending sideways and substantially perpendicular to the main handle direction, and being configured to receive one or more fingers of an operator, a top casing element connected to the frame element and covering at least a portion of a top side of the frame element, and a bottom casing element connected to the frame element and covering at least a portion of the bottom side of the frame element, a first side casing part disposed on one side of the first housing; and a second side casing part disposed on opposite side of the first housing;

wherein the first side casing part and second side casing part extend between the top casing element and the bottom casing element, and are connected to the frame element; and wherein the frame element, the top casing element and the bottom casing element are arranged to form at least part of a vacuum source housing for accommodating at least a part of a vacuum source; and a second housing comprising:

a debris collecting compartment, and a nozzle, wherein the second housing is detachably connected to the first housing adjacent the vacuum source housing.

13. The vacuum cleaner according to claim 12, wherein the frame element comprises flanges extending on both sides of the frame element around at least a portion of the through hole to thereby provide the frame element with a generally U-shaped cross section along the portion.

14. The vacuum cleaner according to claim 13, wherein the portion comprises a majority of the through hole.

15. The vacuum cleaner according to claim 13, wherein the portion comprises the entire through hole.

16. The housing according to claim 12, wherein at least one of the first side casing part and the second side casing part comprises one or more air openings adapted to pass exhaust air from the vacuum source.

* * * * *